US008840975B2

(12) United States Patent
Oguri et al.

(10) Patent No.: US 8,840,975 B2
(45) Date of Patent: Sep. 23, 2014

(54) RECORDING MEDIUM

(71) Applicant: Canon Kabushiki Kaisha, Tokyo (JP)

(72) Inventors: Isamu Oguri, Yokohama (JP); Hisao Kamo, Ushiku (JP); Tetsuro Noguchi, Hachioji (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/843,268

(22) Filed: Mar. 15, 2013

(65) Prior Publication Data

US 2013/0266748 A1 Oct. 10, 2013

(30) Foreign Application Priority Data

Apr. 5, 2012 (JP) ..... 2012-086535

(51) Int. Cl.
*B41M 5/40* (2006.01)
*B41M 5/52* (2006.01)

(52) U.S. Cl.
CPC ..... *B41M 5/529* (2013.01); *B41M 5/5218* (2013.01); *B41M 5/5254* (2013.01); *B41M 5/5245* (2013.01); *B41M 5/5263* (2013.01); *B41M 5/52* (2013.01)
USPC ..... 428/32.28; 428/32.29; 428/32.3; 428/32.34; 428/32.38

(58) Field of Classification Search
CPC ..... B41M 5/52; B41M 5/5254; B41M 5/5218
USPC ..... 428/32.28, 32.29, 32.3, 32.34, 32.38
See application file for complete search history.

(56) References Cited

U.S. PATENT DOCUMENTS

| | | | | |
|---|---|---|---|---|
| 2002/0025412 | A1* | 2/2002 | Hanmura et al. | 428/195 |
| 2005/0139338 | A1* | 6/2005 | Shibatani et al. | 162/125 |
| 2007/0196598 | A1* | 8/2007 | Koike et al. | 428/32.34 |
| 2008/0075847 | A1* | 3/2008 | Kobayashi | 427/152 |

FOREIGN PATENT DOCUMENTS

| | | | |
|---|---|---|---|
| JP | 2001-341418 | A | 12/2001 |
| JP | 2005-280035 | A | 10/2005 |
| WO | 2008/130045 | A1 | 10/2008 |

* cited by examiner

*Primary Examiner* — Betelhem Shewareged
(74) *Attorney, Agent, or Firm* — Canon U.S.A., Inc., IP Division

(57) ABSTRACT

A recording medium includes a base and an ink-receiving layer. The ink-receiving layer includes inorganic particles, a binder, poly(diallyldimethylamine hydrochloride), a cationic polymer having a sulfonyl group, and a polyvalent metal.

7 Claims, No Drawings

RECORDING MEDIUM

BACKGROUND OF THE INVENTION

1. Field of the Invention

The present invention relates to a recording medium.

2. Description of the Related Art

A recording medium having an ink-receiving layer constituted of inorganic particles and a binder is excellent in color development and glossiness of an image, but the ozone resistance of the image is low. This is because that the ink-receiving layer has many pores and thereby has a large surface area that is in contact with ozone in the air to easily cause discoloration of an image. Accordingly, a recording medium having an ink-receiving layer containing a specific compound that can improve the ozone resistance of an image has been investigated (Japanese Patent Laid-Open No. 2001-341418). This Patent Literature describes an improvement in the ozone resistance of an image by an ink-receiving layer containing an amino compound having repeating alkylene oxide groups and a diallylamine hydrochloride-sulfur dioxide copolymer as a cationic polymer, in addition to gas-phase method silica as inorganic particles and polyvinyl alcohol as a binder.

International Publication No. WO2008/130045 describes improvements in the bronze resistance and humidity resistance of an image by an ink-receiving layer having two layered structure of which only the lower layer contains a cationic polymer selected from poly(allylamine hydrochloride), poly(methyldiallylamine hydrochloride), and diallylamine hydrochloride-sulfur dioxide copolymers. Japanese Patent Laid-Open No. 2005-280035 describes improvements in the bleed resistance and color development of an image by a recording medium having an ink-receiving layer prepared by laminating a finish coat layer containing a cationic polymer on an undercoat layer containing calcium carbonate and a binder.

However, according to the investigation by the present inventors, though the ozone resistance of an image is improved in the recording medium described in Japanese Patent Laid-Open No. 2001-341418, the color development of the image is low. In the recording medium described in International Publication No. WO2008/130045, the ozone resistance of an image is low. In also Japanese Patent Laid-Open No. 2005-280035, the color development of an image is low in some cases.

SUMMARY OF THE INVENTION

The present invention provides a recording medium, in which the resulting image can have excellent ozone resistance and color development.

That is, the recording medium according to the present invention includes a base and an ink-receiving layer containing inorganic particles, a binder, poly(diallyldimethylamine hydrochloride), a cationic polymer having a sulfonyl group, and a polyvalent metal.

According to the present invention, a recording medium, in which the resulting image can have excellent ozone resistance and color development, is provided.

Further features of the present invention will become apparent from the following description of exemplary embodiments.

DESCRIPTION OF THE EMBODIMENTS

The present invention will now be described in detail by embodiments. The present inventors investigated why an image having high ozone resistance and color development cannot be obtained in the above-described known recording media. The details are shown below.

In Japanese Patent Laid-Open No. 2001-341418, gas-phase method silica is used. The gas-phase method silica has low dispersion stability and, as a result, reduces the transparency of the ink-receiving layer, resulting in low color development of a resulting image. In International Publication No. WO2008/130045, since only the lower layer contains a cationic polymer, when an ink is applied to the recording media, the coloring material in the ink is fixed to the upper layer of the ink-receiving layer, resulting in a reduction in the ozone resistance of the resulting image. In Japanese Patent Laid-Open No. 2005-280035, calcium carbonate is used. Since calcium carbonate has low dispersion stability and, as a result, reduces the transparency of the ink-receiving layer, resulting in low color development of the resulting image.

Base on these results, the present inventors investigated various compounds and have found that an image having high ozone resistance and color development can be obtained by the structure of the present invention, that is, when the ink-receiving layer of a recording medium contains inorganic particles, poly(diallyldimethylamine hydrochloride), a cationic polymer having a sulfonyl group, and a polyvalent metal. In particular, a combination of three compounds, i.e., poly(diallyldimethylamine hydrochloride), a cationic polymer having a sulfonyl group, and a polyvalent metal, provides unexpectedly high ozone resistance and color development to an image, compared to the cases of using each compound separately and of using in a combination of two of them. The present inventors speculate the reason of the effects of the structure of the present invention as follows.

In the cationic polymer having a sulfonyl group, the electron density of the cationic groups is reduced due to the electron-withdrawing sulfonyl group. As a result, the association with the coloring material is strengthened to improve the ozone resistance of the resulting image. On this occasion, the polyvalent metal enhances the activity of the sulfonyl group to further increase the effect of improving the ozone resistance of the image. In addition, the poly(diallyldimethylamine hydrochloride) enhances the dispersion stability of the inorganic particles to increase the transparency of the ink-receiving layer, resulting in an improvement in the color development of the resulting image. Also on this occasion, the cationic polymer having a sulfonyl group and the polyvalent metal further enhances the color development of the image.

As in the mechanism described above, the effects of the constituent elements synergistically affect each other to achieve the effects of the present invention.

Recording Medium

The recording medium of the present invention has an ink-receiving layer on at least one surface of the base. Each component constituting the recording medium of the present invention will now be described.

Ink-Receiving Layer

In the present invention, the ink-receiving layer of the recording medium contains inorganic particles, a binder, poly (diallyldimethylamine hydrochloride), a cationic polymer having a sulfonyl group, and a polyvalent metal.

In the present invention, the ink-receiving layer can have a thickness of 15 μm or more and 45 μm or less. The thickness of the ink-receiving layer is determined by measuring thicknesses of at least five points of a cross section of the recording medium with a scanning electron microscope (SEM) and calculating the average thereof. Each component constituting the ink-receiving layer will now be described.

(1) Inorganic Particles

In the present invention, the inorganic particles contained in the ink-receiving layer can have an average primary particle diameter of 1 nm or more and 1 μm or less, in particular, 30 nm or less. The average primary particle diameter can be 3 nm or more and 10 nm or less. In the present invention, the average primary particle diameter of the inorganic particles is the number-average particle diameter of the diameters of circles having the same areas as projected areas of primary particles of the inorganic particles observed by an electron microscope. On this occasion, the measurement is performed for at least 100 points.

In the present invention, the content (mass %) of the inorganic particles in the ink-receiving layer can be 50 mass % or more and 98 mass % or less, in particular, 70 mass % or more and 96 mass % or less.

In the present invention, the application amount ($g/m^2$) of the inorganic particles in the formation of the ink-receiving layer can be 8 $g/m^2$ or more and 45 $g/m^2$ or less. In this range, the ink-receiving layer can readily have a desired thickness.

Examples of the inorganic particles used in the present invention include hydrated alumina, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. These inorganic particles can be used in one type or two or more types thereof, as necessary. Among the inorganic particles, hydrated alumina and silica can form porous structures having high ink-absorbing properties and can be particularly used. Furthermore, silica can be particularly used from the viewpoint of an effect of inhibiting the heat-induced yellowing of the recording medium.

Hydrated Alumina

The hydrated alumina contained in the ink-receiving layer can have a structure represented by the following Formula (X):

$$Al_2O_{3-n}(OH)_{2n}\cdot mH_2O \quad \text{(X):}$$

(in Formula (X), n represents 0, 1, 2, or 3, and m represents a number of 0 to 10, in particular, 0 to 5, wherein since $mH_2O$, in most cases, represents a removable water phase not involved in the formation of a crystal lattice, m can represent a value other than integers and can be a value of 0 when the hydrated alumina is heated, provided that m and n are not simultaneously 0).

In the present invention, the hydrated alumina can be produced by a known method, and specific examples of the method include hydrolysis of alumina alkoxide, hydrolysis of sodium aluminate, and neutralization of an aqueous sodium aluminate solution with an aqueous aluminum sulfate or aluminum chloride solution.

It is known that hydrated alumina has crystalline structures of amorphous, gibbsite-type, and boehmite-type, depending on the temperature of heat treatment, and all of these crystalline structures can be used in the present invention. In particular, hydrated alumina showing the boehmite structure or amorphous in X-ray diffraction analysis can be used. Specific examples of the hydrated alumina include those described in Japanese Patent Laid-Open Nos. 7-232473, 8-132731, 9-66664, and 9-76628 and commercially available hydrated alumina such as Disperal HP14 (manufactured by Sasol Limited) and Disperal HP18 (manufactured by Sasol Limited). These hydrated alumina products can be used alone or in a combination of two or more thereof, as necessary.

Furthermore, in the present invention, the hydrated alumina can has a specific surface area of 100 $m^2/g$ or more and 200 $m^2/g$ or less, in particular, 125 $m^2/g$ or more and 175 $m^2/g$ or less, determined by a Brunauer-Emmett-Teller (BET) method. In the BET method, the surface area of a powder is measured by gas-phase adsorption, and the total surface area of 1 g of a powder sample, i.e., the specific surface area is determined, from an adsorption isotherm. Usually, nitrogen gas is used as the adsorption gas, and a method of measuring the amount of adsorbed gas from the change in pressure or volume of the adsorption gas is most frequently employed. The most famous equation expressing the isotherm of polymolecular adsorption is the Brunauer-Emmett-Teller equation referred to as the BET equation, which is widely used for determination of a specific surface area. The specific surface area is obtained by determining the adsorption amount based on the BET method and multiplying the adsorption amount by the surface area of one adsorbed molecule. In the BET method, a relationship between adsorption amounts and relative pressures is determined through measurement of several points by a nitrogen adsorption-desorption method, and the slope and intercept of the plots are calculated by a least squares method, thereby finding the specific surface area. In order to increase the accuracy of measurement, the relationship between adsorption amounts and relative pressures is determined by measuring adsorption amounts at least five points, such as 10 or more points.

In the present invention, the application amount ($g/m^2$) of the hydrated alumina in the formation of the ink-receiving layer can be 15 $g/m^2$ or more, in particular, 25 $g/m^2$ or more and 45 $g/m^2$ or less. An application amount of less than 25 $g/m^2$ may provide insufficient ink-absorbing properties, and an application amount of higher than 45 $g/m^2$ may cause cracking during drying in the production of a recording medium.

Silica

In general, the silica used in the ink-receiving layer is roughly classified based on the production process into wet method and dry method (gas-phase method). As a wet method, preparation of hydrated silica by generating activated silica through acidolysis of a silicate and appropriately polymerizing the activated silica to aggregate/precipitate the silica is known. As a dry method (gas-phase method), preparation of anhydrous silica by high-temperature gas-phase hydrolysis of halogenated silicon (flame hydrolysis) or by thermal reduction-vaporization of silica sand and coke through arcing in an electric furnace and oxidation the resulting product with air (arc process) is known. In the present invention, in particular, silica prepared by dry method (gas-phase method) (hereinafter, also referred to as "gas-phase method silica") can be used. The gas-phase method silica has a particularly large specific surface area and thereby shows particularly high ink-absorbing properties and retention efficiency and a low refractive index to provide transparency to the ink-receiving layer and satisfactory color development. Specific examples of the gas-phase method silica include Aerosil (manufactured by Nippon Aerosil Co., Ltd.) and Reolosil QS type (manufactured by Tokuyama Corporation).

In the present invention, the gas-phase method silica can have a specific surface area (by the BET method) of 50 $m^2/g$ or more and 400 $m^2/g$ or less, in particular, 200 $m^2/g$ or more and 350 $m^2/g$ or less.

In the present invention, the application amount ($g/m^2$) of the gas-phase method silica in the formation of the ink-receiving layer can be 8 $g/m^2$ or more, in particular, 10 $g/m^2$ or more and 30 $g/m^2$ or less. An application amount of less than 10 $g/m^2$ may provide insufficient ink-absorbing properties, and an application amount of higher than 30 $g/m^2$ may cause cracking during drying in the production of a recording medium.

In the present invention, the gas-phase method silica dispersed with a cationic dispersant can be added to a coating solution for ink-receiving layer. The gas-phase method silica in the dispersed state can have a particle diameter of 500 nm or less, in particular, 200 nm or less, from the viewpoint of color development of an image. The particle diameter of the gas-phase method silica in the dispersed state can be measured by dynamic light scattering.

(2) Binder

In the present invention, the ink-receiving layer contains a binder. The binder may be any material that can bind the inorganic particles and can form a coat and does not impair the effects of the present invention.

Examples of the binder include starch derivatives such as oxidized starch, esterified starch, and phosphorylated starch; cellulose derivatives such as carboxymethyl cellulose and hydroxyethyl cellulose; casein, gelatin, soybean protein, polyvinyl alcohol (PVA), and derivatives thereof; various polymers such as polyvinylpyrrolidone and maleic anhydride resins and conjugated polymer latex such as styrene-butadiene copolymers and methyl methacrylate-butadiene copolymers; acrylic polymer latex such as polymers of acrylate and methacrylate; vinyl polymer latex such as ethylene-vinyl acetate copolymers; functional group-modified polymer latex of the above-mentioned various polymers of monomers containing functional groups such as carboxyl groups; the above-mentioned polymers cationized with cationic groups and the above-mentioned polymers of which surfaces are cationized with cationic surfactants; the above-mentioned polymers polymerized in the presence of cationic polyvinyl alcohol so as to distribute the polyvinyl alcohol on the polymer surfaces; the above-mentioned polymers polymerized in a suspension/dispersion of cationic colloidal particles so as to distribute the cationic colloidal particles on the polymer surfaces; aqueous binders such as thermosetting synthetic resins, e.g., melamine resins and urea resins; polymer and copolymer resins of methacrylate and acrylate such as polymethyl methacrylate; and synthetic resin binders such as polyurethane resins, unsaturated polyester resins, vinyl chloride-vinyl acetate copolymers, polyvinyl butyral, and alkyd resins. These binders may be used alone or in a combination of two or more thereof, as necessary.

Among the above-mentioned binders, polyvinyl alcohol (PVA) and polyvinyl alcohol derivatives can be particularly used. Examples of the polyvinyl alcohol derivative include cation-modified polyvinyl alcohol, anion-modified polyvinyl alcohol, silanol-modifiked polyvinyl alcohol, and polyvinyl acetal. The PVA can be synthesized by hydrolysis (saponification) of polyvinyl acetate. The degree of saponification of the PVA can be 80 mol % or more and 100 mol % or less, in particular, 85 mol % or more and 100 mol % or less. The degree of saponification is the ratio of the molar number of hydroxyl groups generated by saponification of polyvinyl acetate to polyvinyl alcohol, and is a value measured by the method described in JIS-K6726. In addition, the PVA can have an average polymerization degree of 1500 or more, in particular, 2000 or more and 5000 or less. Incidentally, the average polymerization degree herein is the average polymerization degree determined by the method described in JIS-K6726. In the present invention, the content of the inorganic particles contained in the ink-receiving layer of the recording medium can be three to twenty times the content of the binder, in terms of mass ratio.

(3) Crosslinking Agent

In the present invention, the ink-receiving layer may contain a crosslinking agent. Examples of the crosslinking agent include aldehyde compounds, melamine compounds, isocyanate compounds, zirconium compounds, amide compounds, aluminum compounds, boric acids, and boric acid salts. These crosslinking agents can be used alone or in a combination of two or more thereof, as necessary. Among the above-mentioned crosslinking agents, boric acids and boric acid salts have a notable effect of inhibiting cracking of the ink-receiving layer and can be particularly used.

Examples of the boric acid include orthoboric acid ($H_3BO_3$), metaboric acid, and diboric acid. The boric acid salt can be any of water-soluble salts of these boric acids, and examples of the boric acid salt include alkali metal salts of boric acids such as sodium salts and potassium salts of boric acids; alkaline earth metal salts of boric acids such as magnesium salts and calcium salts of boric acids; and ammonium salts of boric acids. Among these boric acids and boric acid salts, orthoboric acid has notable effects of stabilizing the coating solution for a long time and inhibiting cracking and can be particularly used.

The amount of the boric acid or boric acid salt can be appropriately selected depending on, for example, the production conditions. The content of the boric acid or boric acid salt can be 5.0 mass % or more and 50.0 mass % or less relative to the content of the binder contained in the ink-receiving layer.

(4) Poly(Diallyldimethylamine Hydrochloride)

In the present invention, the ink-receiving layer contains poly(diallyldimethylamine hydrochloride). The poly(diallyldimethylamine hydrochloride) can have a weight-average molecular weight of 100000 or less, in particular, 2000 or more and 50000 or less. Specific examples of the poly(diallyldimethylamine hydrochloride) include SHALLOL DC902P (manufactured by Daiichi Kogyo Seiyaku Co., Ltd.) and PAS-H-1L (manufactured by Nittobo Medical Co., Ltd.).

The amount of the poly(diallyldimethylamine hydrochloride) contained in the ink-receiving layer can be 1 part by mass or more, in particular, 2 parts by mass or less, based on 100 parts by mass of the inorganic particles from the viewpoint of the dispersion stability of the inorganic particles, and can be 10 parts by mass or less, in particular, 5 parts by mass or less, based on 100 parts by mass of the inorganic particles from the viewpoint of the ink-absorbing properties.

(5) Cationic Polymer Having a Sulfonyl Group

In the present invention, the ink-receiving layer contains a cationic polymer having a sulfonyl group. The cationic polymer having a sulfonyl group can be prepared by copolymerization of a cationic monomer, such as diallylamine hydrochloride, methyldiallylamine hydrochloride, or diallyldimethylammonium chloride, with sulfur dioxide. Specific examples of the cationic polymer having a sulfonyl group include compounds represented by the following Formula (1) and compounds represented by the following Formula (2):

[Chem. 1]

Formula (1)

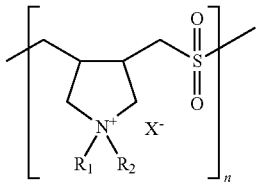

-continued

[Chem. 2]

Formula (2)

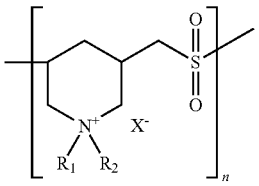

(in Formulae (1) and (2), $R_1$ and $R_2$ each represent a hydrogen atom or an alkyl group, provided that $R_1$ and $R_2$ are not simultaneously hydrogen atoms; $X^-$ represents a halogen ion, a sulfate ion, a sulfonate ion, an alkylsulfonate ion, an acetate ion, an alkylcarboxylate ion, or a phosphate ion; and n is an integer).

Examples of the compound represented by Formula (1) or (2) include diallylamine hydrochloride-sulfur dioxide copolymer PAS-92, methyldiallylamine hydrochloride-sulfur dioxide copolymer PAS-2201CL, and diallyldimethylammonium chloride-sulfur dioxide copolymer PAS-A-5 (these are manufactured by manufactured by Nittobo Medical Co., Ltd.). In the present invention, the compounds represented by Formula (1) can be particularly used. Furthermore, PAS-2201CL and PAS-A-5 are superior to PAS-92 in the effect of inhibiting the heat-induced yellowing of the recording medium.

The amount of the cationic polymer having a sulfonyl group contained in the ink-receiving layer can be 0.1 parts by mass or more, in particular, 0.3 parts by mass or more, based on 100 parts by mass of the inorganic particles from the viewpoint of the ozone resistance of an image, and can be 5 parts by mass or less, in particular, 2 parts by mass or less, based on 100 parts by mass of the inorganic particles from the viewpoints of the ink-absorbing properties and the color development of an image.

(6) Polyvalent Metal

The recording medium of the present invention contains a polyvalent metal in the ink-receiving layer. In the present invention, the "polyvalent metal" contained in the ink-receiving layer includes the polyvalent metal in its ion form and the polyvalent metal in its salt form. Examples of the polyvalent metal include di- or more valent metals. Examples of the divalent metal include alkaline earth metals such as beryllium, magnesium, calcium, strontium, barium, zirconium, and radium. Examples of the trivalent metal include aluminum, yttrium, zirconium, iron, and other transition metals. In the present invention, such a polyvalent metal can be added to the coating solution for ink-receiving layer in a water-soluble salt form such as a hydroxide, a chloride, or a nitrate. Incidentally, in the present invention, the term "water-soluble" refers to that the solubility in water under ordinary temperature and ordinary pressure is 1 mass % or more.

In the present invention, among the water-soluble salts of the above-mentioned polyvalent metals, water-soluble salts of zirconium and aluminum can be particularly used. Specific examples of the water-soluble salts of zirconium include zirconium acetate, zirconium chloride, zirconium oxychloride, zirconium hydroxychloride, zirconium nitrate, basic zirconium carbonate, zirconium hydroxide, zirconium ammonium carbonate, zirconium potassium carbonate, zirconium sulfate, and zirconium fluoride. In particular, zirconium acetate can be used. Examples of the zirconium acetate include Zircosol ZA-30 (manufactured by Daiichi Kigenso Kagaku Kogyo Co., Ltd.). Examples of the water-soluble salt of aluminum include poly(aluminum chloride) (manufactured by Taki Chemical Co., Ltd.), poly(aluminum hydroxide) (manufactured by Asada Chemical Industry Co., Ltd.), and HAP-25 (manufactured by RIKENGREEN Co., Ltd.).

The amount of the polyvalent metal contained in the ink-receiving layer can be 0.1 parts by mass or more, in particular, 0.3 parts by mass or more, based on 100 parts by mass of the inorganic particles from the viewpoint of the ozone resistance of an image, and can be 10 parts by mass or less, in particular, 5 parts by mass or less, based on 100 parts by mass of the inorganic particles from the viewpoints of the ink-absorbing properties and the color development of an image.

(7) Sulfur-Containing Compound

In the present invention, the ink-receiving layer can contain a sulfur-containing compound in addition to the cationic polymer having a sulfonyl group, from the viewpoint of the light resistance of an image. Examples of the sulfur-containing compound include β-thiodiglycol, 3,6-dithiaoctanediol, 2,2'-thiodiglycolic acid, 3,3'-thiodipropionic acid, 2,2'-thiobis(ethylamine), and 3-methylthiopropylamine. The sulfur-containing compound may be a polymer compound.

(8) Other Materials

In the present invention, the ink-receiving layer may contain other materials in addition to the above-described materials. Examples of such additional materials include pH adjusters, thickeners, fluidity modifiers, antifoaming agents, foam inhibitors, surfactants, release agents, penetrants, color pigments, color dyes, fluorescent brightening agents, ultraviolet absorbers, antioxidants, antiseptics, antifungal agents, water resistant additives, dye-fixing agents, hardening agents, and weather resistant materials.

Base

The base used in the recording medium of the present invention may be any base, and examples of usable base include paper such as fine paper, medium quality paper, coated paper, art paper, and cast-coated paper; synthetic paper; white plastic films; transparent plastic films; translucent plastic films; and resin-coated paper.

In order to achieve effective expression of the glossiness of an image, the base should have high barrier properties against the coating solution for forming the ink-receiving layer. Examples of such a base include white plastic films opacified by pore-introduction through addition of a pigment such as titanium oxide or barium sulfate to, for example, polyethylene terephthalate, polyvinyl chloride, polycarbonate, polyimide, polyacetate, polyethylene, polypropylene, or polystyrene; and resin-coated paper, i.e., base paper laminated with a thermosetting resin such as polyethylene or polypropylene.

In order to allow the recording medium to achieve image quality and texture equivalent to those of silver halide photography, the base paper used as the base can be polyolefin resin-coated paper where at least the surface on which the ink-receiving layer is provided is coated with a polyolefin resin, in particular, polyolefin resin-coated paper where the both surfaces are coated with a polyolefin resin. The polyolefin resin-coated paper can have a ten-point average roughness, measured in accordance with JIS-B0601, of 0.5 μm or less and a 60-degree specular glossiness, measured in accordance with JIS-Z-8741, of 25% or more and 75% or less.

The resin-coated paper can have any thickness, for example, a thickness of 25 μm or more and 500 μm or less. Resin-coated paper having a thickness of not less than 25 μm can effectively prevent the rigidity of the recording medium from decreasing and can effectively prevent occurrence of disadvantages such as degradations in the feel and texture when the recording medium is touched and a reduction in opacity. Resin-coated paper having a thickness of 500 μm or less can effectively prevent an increase in rigidity of the recording medium to avoid causing difficulty in handling and can smoothly feed paper in an ink-jet recording apparatus. The resin-coated paper can have a thickness of 50 μm or more and 300 μm or less. The resin coated paper can have any basis weight, for example, a basis weight of 25 g/m$^2$ or more and 500 g/m$^2$ or less.

Method of Producing Recording Medium

In the present invention, the recording medium may be produced by any method and can be produced, for example, by a method including a process of coating a base with a coating solution for ink-receiving layer. The method of producing the recording medium will now be described.

Method of Producing Base

In the recording medium of the present invention, the base can be produced by a common process of producing paper. Examples of the papermaking machine include Fourdrinier paper machines, cylinder paper machines, drum paper machines, and twin wire paper machines.

The base of the recording medium of the present invention may be coated with a porous material, such as light calcium carbonate, heavy calcium carbonate, alumina, silica, or silicate, by a size press process, which is usually performed in papermaking. The coating may be performed by a common coating process. Specific examples of such a process include a coating technology using a device such as a gate roll coater, size press, bar coater, blade coater, air-knife coater, roll coater, blush coater, curtain coater, gravure coater, or spray equipment. The resulting base may be subjected to calender treatment, thermocalender treatment, or super calender treatment to smoothen the surface thereof.

Method of Forming Ink-Receiving Layer

In the recording medium of the present invention, an ink-receiving layer can be formed on a base, for example, by mixing inorganic particles, a binder, poly(diallyldimethylamine hydrochloride), a cationic polymer having a sulfonyl group, a polyvalent metal, and optional other additives to prepare a coating solution, applying the coating solution onto the base, and drying it. The coating may be performed by any technology exemplified in the "Method of producing base" above. The coating amount of the coating solution can be 5 g/m$^2$ or more and 45 g/m$^2$ or less in terms of dried solid content. An application amount of 5 g/m$^2$ or more can provide good ink-absorbing properties. An application amount of 45 g/m$^2$ or less can prevent occurrence of cockling. After the formation of the ink-receiving layer, the surface of the recording medium may be smoothened by calender treatment, thermocalender treatment, or super calender treatment.

EXAMPLES

The present invention will now be more specifically described by examples and comparative examples, but is not limited by the following examples, within the scope of the present invention. In the following examples, the term "part(s)" is on a mass basis unless otherwise specified.

Example 1

Production of Base

A base was produced under the following conditions. Paper stuff of the following composition was prepared with water so as to have a solid content of 3 mass %.

Paper Stuff Composition:

| | |
|---|---|
| Pulp (80 parts of broadleaf tree bleached kraft pulp (LBKP) having a freeness of 450 mL CSF (Canadian Standard Freeness) and 20 parts of needle-leaf bleached kraft pulp (NBKP) having a freeness of 480 mL CSF) | 100 parts |
| Cationized starch | 0.60 parts |
| Heavy calcium carbonate | 10 parts |
| Light calcium carbonate | 15 parts |
| Alkyl ketene dimer | 0.10 parts |
| Cationic polyacrylamide | 0.03 parts |

The resulting paper stuff was formed into a sheet with a Fourdrinier paper machine, and the sheet was subjected to three-stage wet pressing, followed by drying with a multi-cylinder dryer. The resulting paper was impregnated with an aqueous oxidized starch solution in a coating amount of 1.0 g/m$^2$ using a size press apparatus and was dried, followed by finishing with a machine calender to give base paper having a basis weight of 170 g/m$^2$, a stockigt sizing degree of 100 seconds, an air permeability of 50 seconds, a Bekk smoothness of 30 seconds, and a Gurley stiffness of 11.0 mN.

Onto the resulting base paper, a resin composition composed of 70 parts of low-density polyethylene, 20 parts of high-density polyethylene, and 10 parts of titanium oxide was applied in an amount of 25 g/m$^2$. Onto the back surface of the base paper, a resin composition composed of 50 parts of high-density polyethylene and 50 parts of low-density polyethylene was applied in an amount of 25 g/m$^2$ to give a resin-coated base.

Preparation of Gas-Phase Method Silica Sol A

To 79.23 parts of deionized water added was 1.54 parts of poly(diallyldimethylamine hydrochloride) (SHALLOL DC902P, manufactured by Daiichi Kogyo Seiyaku Co., Ltd., solid content: 50 mass %). 19.23 parts of gas-phase method silica (AEROSIL 300, manufactured by EVONIK Industries A.G.) was gradually added to the resulting aqueous cationic polymer solution with stirring with a T.K. homomixer (model: MARK II 2.5, manufactured by Tokusyu Kika Kogyo Co., Ltd.) at 3000 rpm (the amount of poly(diallyldimethylamine hydrochloride) was 4 parts by mass based on 100 parts by mass of gas-phase method silica in terms of solid content). Furthermore, treatment with a Nanomizer (manufactured by Yoshida Kikai Co., Ltd.) was performed twice to prepare gas-phase method silica sol A having a solid content of 20 mass %.

Preparation Binder Solution

Polyvinyl alcohol (PVA 235, manufactured by Kuraray Co., Ltd., viscosity average polymerization degree: 3500, saponification degree: 88 mol %) was dissolved in deionized water to give a binder solution having a solid content of 8.0 mass %.

Preparation of Coating Solution for Ink-Receiving Layer

A cationic polymer having a sulfonyl group (diallyldimethylammonium chloride-sulfur dioxide copolymer, PAS-A-5, manufactured by Nittobo Medical Co., Ltd., solid content: 40 mass %), a water-soluble salt of a polyvalent metal (zirconium acetate, ZA-30, manufactured by Daiichi Kigenso Kagaku Kogyo Co., Ltd., solid content: 30 mass %), and an aqueous binder solution were mixed with gas-phase method silica sol A in amounts of 1.0 part, 2.0 parts, and 20.0 parts, respectively, in terms of solid content, based on 100 parts of the gas-phase method silica solid content contained in gas-phase method silica sol A to give a mixture solution. Subsequently, a crosslinking agent (aqueous orthoboric acid solution, solid content: 5 mass %) was mixed with the resulting mixture solution in an amount of 20.0 parts, in terms of solid content, based on 100 parts of the polyvinyl alcohol solid content contained in the mixture solution. Furthermore, a surfactant (Surfinol 465, manufactured by Nissin Chemical Co., Ltd.) was added thereto in an amount of 0.1 mass % based on the total mass of the coating solution to give a coating solution for ink-receiving layer.

Production of Recording Medium

The coating solution for ink-receiving layer was heated to 40° C. and was applied onto the base produced above to form a layer having a dried thickness of 40 μm with a slide die, followed by drying at 50° C. to produce a recording medium of Example 1.

Examples 2 to 5

Recording media of Examples 2 to 5 were produced as in Example 1 except that the amounts of the cationic polymer having a sulfonyl group (diallyldimethylammonium chloride-sulfur dioxide copolymer, PAS-A-5) in "Preparation of coating solution for ink-receiving layer" in Example 1 were 0.3 parts, 0.5 parts, 2.0 parts, and 4.0 parts, respectively.

Examples 6 to 9

Recording media of Examples 6 to 9 were produced as in Example 1 except that the amounts of the water-soluble polyvalent metal salt (zirconium acetate, ZA-30) in "Preparation of coating solution for ink-receiving layer" in Example 1 were 0.5 parts, 1.0 part, 4.0 parts, and 6.0 parts, respectively.

Example 10

A recording medium of Example 10 was produced as in Example 1 except that 2.0 parts of basic poly(aluminum chloride) (HAP-25, manufactured by RIKENGREEN Co., Ltd., solid content: 44 mass %) was used in place of 2.0 parts of the water-soluble polyvalent metal salt (zirconium acetate, ZA-30) in "Preparation of coating solution for ink-receiving layer" in Example 1.

Example 11

A recording medium of Example 11 was produced as in Example 1 except that 1.0 part of zirconium acetate (ZA-30) and 1.0 part of basic poly(aluminum chloride) (HAP-25) were used in place of 2.0 parts of the water-soluble polyvalent metal salt (zirconium acetate, ZA-30) in "Preparation of coating solution for ink-receiving layer" in Example 1.

Example 12

A recording medium of Example 12 was produced as in Example 1 except that 1.0 part of a diallylmethylethylammonium ethylsulfate-sulfur dioxide copolymer (PAS-2401, manufactured by Nittobo Medical Co., Ltd., solid content: 25 mass %) was used in place of 1.0 part of the cationic polymer having a sulfonyl group (diallyldimethylammonium chloride-sulfur dioxide copolymer, PAS-A-5) in "Preparation of coating solution for ink-receiving layer" in Example 1.

Example 13

A recording medium of Example 13 was produced as in Example 1 except that 1.0 part of a methyldiallylamine hydrochloride-sulfur dioxide copolymer (PAS-2201CL, manufactured by Nittobo Medical Co., Ltd., solid content: 25 mass %) was used in place of 1.0 part of the cationic polymer having a sulfonyl group (diallyldimethylammonium chloride-sulfur dioxide copolymer, PAS-A-5) in "Preparation of coating solution for ink-receiving layer" in Example 1.

Example 14

A recording medium of Example 14 was produced as in Example 1 except that 1.0 part of a diallylamine hydrochloride-sulfur dioxide copolymer (PAS-92, manufactured by Nittobo Medical Co., Ltd., solid content: 20 mass %) was used in place of 1.0 part of the cationic polymer having a sulfonyl group (diallyldimethylammonium chloride-sulfur dioxide copolymer, PAS-A-5) in "Preparation of coating solution for ink-receiving layer" in Example 1.

Example 15

A Recording medium of Example 15 was produced as in Example 1 except that a sulfur-containing compound, 3,6-dithiaoctanediol, was further added to the gas-phase method silica sol A in "Preparation of coating solution for ink-receiving layer" in Example 1 in amount of 2.0 parts, in terms of solid content, based on 100 parts of gas-phase method silica solid content contained in the gas-phase method silica sol A.

Example 16

Preparation of Sulfur-Containing Polymer Dispersion

A reaction vessel equipped with a stirrer, a thermometer, and a reflux-cooling tube was charged with 109.00 g of acetone as a reaction solvent, and 40.00 g of 3,6-dithia-1,8-octanediol and 6.79 g of methyldiethanolamine were added thereto with stirring. After dissolution, the temperature of the reaction solution was raised to 40° C., and 62.07 g of isophorone diisocyanate was added thereto. Subsequently, the temperature was raised to 50° C., and 0.20 g of a tin-based catalyst was added to the reaction solution. The temperature was further raised to 55° C., and the reaction was allowed to proceed with stirring for 4 hours to synthesize a sulfur-containing polymer compound. After completion of the reaction, the reaction solution was cooled to room temperature, and 3.09 g of 85% formic acid was added thereto to cationize the sulfur-containing polymer compound. Furthermore, 446 g of deionized water was added thereto, acetone was removed by vacuum concentration, and the concentration was adjusted with deionized water to prepare sulfur-containing polymer compound dispersion having a solid content of 20 mass %.

Production of Recording Medium

A recording medium of Example 16 was produced as in Example 1 except that the sulfur-containing polymer compound dispersion prepared above was further added to the gas-phase method silica sol A in "Preparation of coating solution for ink-receiving layer" in Example 1 in an amount of 2.0 parts, in terms of solid content, based on 100 parts of the gas-phase method silica solid content contained in the gas-phase method silica sol A.

Example 17

Preparation of Hydrated Alumina Sol

A hydrated alumina peptizing acid, 0.33 parts of methanesulfonic acid, was added to 80 parts of deionized water. 19.67 parts of hydrated alumina (Disperal HP14, manufactured by Sasol Limited) was gradually added to the resulting aqueous methanesulfonic acid solution with stirring with a T.K. homomixer (model: MARK II 2.5, manufactured by Tokusyu Kika Kogyo Co., Ltd.) at 3000 rpm. The stirring was continued for 30 minutes after completion of the addition to prepare hydrated alumina sol having a solid content of 20 mass %.

Preparation of Coating Solution for Ink-Receiving Layer

Poly(diallyldimethylamine hydrochloride) (SHALLOL DC902P), a cationic polymer having a sulfonyl group (diallyldimethylammonium chloride-sulfur dioxide copolymer, PAS-A-5), a water-soluble polyvalent metal salt (zirconium chloride, ZA-30), and an aqueous binder solution were mixed with the hydrated alumina sol in amounts of 3.0 parts, 1.0 part, 2.0 parts, and 10.0 parts, respectively, in terms of solid content, based on 100 parts of the hydrated alumina solid content contained in the hydrated alumina sol to give a mixture solution. Subsequently, a crosslinking agent (aqueous orthoboric acid solution, solid content: 5 mass %) was mixed with the resulting mixture solution in an amount of 10.0 parts, in terms of solid content, based on 100 parts of the polyvinyl alcohol solid content contained in the mixture solution. Furthermore, a surfactant (Surfinol 465, manufactured by Nissin Chemical Co., Ltd.) was added thereto in an amount of 0.1 mass % based on the total mass of the coating solution to give a coating solution for ink-receiving layer.

Production of Recording Medium

The coating solution for ink-receiving layer was heated to 40° C. and was applied onto the base produced above to form a layer having a dried thickness of 40 μm using a slide die, followed by drying at 50° C. to produce a recording medium of Example 17.

Comparative Example 1

A recording medium of Comparative Example 1 was produced as in Example 1 except that the cationic polymer having a sulfonyl group (diallyldimethylammonium chloride-sulfur dioxide copolymer, PAS-A-5) and the water-soluble polyvalent metal salt (zirconium chloride, ZA-30) in "Preparation of coating solution for ink-receiving layer" in Example 1 were not used.

Comparative Example 2

A recording medium of Comparative Example 2 was produced as in Example 1 except that the water-soluble polyvalent metal salt (zirconium chloride, ZA-30) in "Preparation of coating solution for ink-receiving layer" in Example 1 was not used.

Comparative Example 3

A recording medium of Comparative Example 3 was produced as in Example 1 except that the cationic polymer having a sulfonyl group (diallyldimethylammonium chloride-sulfur dioxide copolymer, PAS-A-5) in "Preparation of coating solution for ink-receiving layer" in Example 1 was not used.

Comparative Example 4

Preparation of Gas-Phase Method Silica Sol B

To 78.85 parts of deionized water added was 1.92 parts of a cationic polymer having a sulfonyl group (diallyldimethylammonium chloride-sulfur dioxide copolymer, PAS-A-5). 19.23 parts of gas-phase method silica (AEROSIL 300, manufactured by EVONIK Industries A.G.) was gradually added to the resulting aqueous cationic polymer solution with stirring with a T.K. homomixer (model: MARK II 2.5, manufactured by Tokusyu Kika Kogyo Co., Ltd.) at 3000 rpm (the amount of the diallyldimethylammonium chloride-sulfur dioxide copolymer was 4 parts by mass based on 100 parts by mass of gas-phase method silica in terms of solid content). Furthermore, treatment with a Nanomizer (manufactured by Yoshida Kikai Co., Ltd.) was performed twice to prepare gas-phase method silica sol B having a solid content of 20 mass %.

Preparation of Coating Solution for Ink-Receiving Layer

A water-soluble polyvalent metal salt (zirconium chloride, ZA-30, manufactured by Daiichi Kigenso Kagaku Kogyo Co., Ltd., solid content: 30 mass %) and an aqueous binder solution were mixed with the gas-phase method silica sol B in amounts of 2.0 parts and 20.0 parts, respectively, in terms of solid content, based on 100 parts of the gas-phase method silica solid content contained in gas-phase method silica sol B to give a mixture solution. Subsequently, a crosslinking agent (aqueous orthoboric acid solution, solid content: 5 mass %) was mixed with the resulting mixture solution in an amount of 20.0 parts, in terms of solid content, based on 100 parts of the polyvinyl alcohol solid content contained in the mixture solution. Furthermore, a surfactant (Surfinol 465, manufactured by Nissin Chemical Co., Ltd.) was added thereto in an amount of 0.1 mass % based on the total mass of the coating solution to give a coating solution for ink-receiving layer.

Production of Recording Medium

The coating solution for ink-receiving layer was heated to 40° C. and was applied onto the base produced above to form a layer having a dried thickness of 40 μm using a slide die, followed by drying at 50° C. to produce a recording medium of Comparative Example 4.

Comparative Example 5

A recording medium of Comparative Example 5 was produced as in Example 15 except that the cationic polymer having a sulfonyl group (diallyldimethylammonium chloride-sulfur dioxide copolymer, PAS-A-5) in "Preparation of coating solution for ink-receiving layer" in Example 15 was not used.

Comparative Example 6

A recording medium of Comparative Example 6 was produced as in Example 1 except that 1.0 part of a cationic polymer not having a sulfonyl group (polymethyldiallylamine, PAS-M-1L, manufactured by Nittobo Medical Co., Ltd., solid content: 25 mass %) was used in place of 1.0 part of the cationic polymer having a sulfonyl group (diallyldimethylammonium chloride-sulfur dioxide copolymer, PAS-A-5) in "Preparation of coating solution for ink-receiving layer" in Example 1.

Comparative Example 7

A recording medium of Comparative Example 7 was produced as in Example 1 except that 1.0 part of a cationic polymer not having a sulfonyl group (poly(allylamine hydrochloride), PAA-HCL-05, manufactured by Nittobo Medical Co., Ltd., solid content: 40 mass %) was used in place of 1.0 part of the cationic polymer having a sulfonyl group (diallyldimethylammonium chloride-sulfur dioxide copolymer, PAS-A-5) in "Preparation of coating solution for ink-receiving layer" in Example 1.

Comparative Example 8

A recording medium of Comparative Example 8 was produced as in Example 1 except that 1.0 part of a cationic polymer not having a sulfonyl group (diallyldimethylammonium chloride-acrylamide copolymer, PAS-J-81L, manufactured by Nittobo Medical Co., Ltd., solid content: 25 mass %) was used in place of 1.0 part of the cationic polymer having a sulfonyl group (diallyldimethylammonium chloride-sulfur dioxide copolymer, PAS-A-5) in "Preparation of coating solution for ink-receiving layer" in Example 1.

Comparative Example 9

Preparation of Gas-Phase Method Silica Sol C

To 76.92 parts of deionized water added was 3.85 parts of a cationic polymer serving as a dispersant (quaternized polydimethylaminomethacrylate, Unisense FPV1000L, manufactured by Senka Corporation, solid content: 20 mass %). 19.23 parts of gas-phase method silica (AEROSIL 300, manufactured by EVONIK Industries A.G.) was gradually added to the resulting aqueous cationic polymer solution with stirring with a T.K. homomixer (model: MARK II 2.5, manufactured by Tokusyu Kika Kogyo Co., Ltd.) at 3000 rpm (the amount of the cationic polymer was 4 parts by mass based on 100 parts by mass of gas-phase method silica in terms of solid content). Furthermore, treatment with a Nanomizer (manufactured by Yoshida Kikai Co., Ltd.) was performed twice to prepare gas-phase method silica sol C having a solid content of 20 mass %.

Production of Recording Medium

A recording medium of Comparative Example 9 was produced as in Example 1 except that gas-phase method silica sol C was used in place of gas-phase method silica sol A in "preparation of coating solution for ink-receiving layer" in Example 1.

Table 1 shows the compositions of ink-receiving layers of the recording media produced above. The abbreviations in Table 1 are as those shown in the description of the method of producing each recording medium.

TABLE 1

Composition of ink-receiving layer of recording medium

| | Composition of ink-receiving layer | | | | | | | |
|---|---|---|---|---|---|---|---|---|
| | Inorganic particles | | Poly(diallyldimethylamine hydrochloride) | | Quarternized polydimethylaminomethacrylate | | Cationic polymer having sulfonyl groups | |
| Example No. | Type | Content (parts by mass) | Type | Content (parts by mass) | Type | Content (parts by mass) | Type | Content (parts by mass) |
| Example 1 | A300 | 100.0 | DC-902P | 4.0 | — | — | PAS-A5 | 1.0 |
| Example 2 | A300 | 100.0 | DC-902P | 4.0 | — | — | PAS-A5 | 0.3 |
| Example 3 | A300 | 100.0 | DC-902P | 4.0 | — | — | PAS-A5 | 0.5 |
| Example 4 | A300 | 100.0 | DC-902P | 4.0 | — | — | PAS-A5 | 2.0 |
| Example 5 | A300 | 100.0 | DC-902P | 4.0 | — | — | PAS-A5 | 4.0 |
| Example 6 | A300 | 100.0 | DC-902P | 4.0 | — | — | PAS-A5 | 1.0 |
| Example 7 | A300 | 100.0 | DC-902P | 4.0 | — | — | PAS-A5 | 1.0 |
| Example 8 | A300 | 100.0 | DC-902P | 4.0 | — | — | PAS-A5 | 1.0 |
| Example 9 | A300 | 100.0 | DC-902P | 4.0 | — | — | PAS-A5 | 1.0 |
| Example 10 | A300 | 100.0 | DC-902P | 4.0 | — | — | PAS-A5 | 1.0 |
| Example 11 | A300 | 100.0 | DC-902P | 4.0 | — | — | PAS-A5 | 1.0 |
| Example 12 | A300 | 100.0 | DC-902P | 4.0 | — | — | PAS-2401 | 1.0 |
| Example 13 | A300 | 100.0 | DC-902P | 4.0 | — | — | PAS-2201CL | 1.0 |
| Example 14 | A300 | 100.0 | DC-902P | 4.0 | — | — | PAS-92 | 1.0 |
| Example 15 | A300 | 100.0 | DC-902P | 4.0 | — | — | PAS-A5 | 1.0 |
| Example 16 | A300 | 100.0 | DC-902P | 4.0 | — | — | PAS-A5 | 1.0 |
| Example 17 | HP14 | 100.0 | DC-902P | 3.0 | — | — | PAS-A5 | 1.0 |
| Comparative Example 1 | A300 | 100.0 | DC-902P | 4.0 | — | — | — | — |
| Comparative Example 2 | A300 | 100.0 | DC-902P | 4.0 | — | — | PAS-A5 | 1.0 |
| Comparative Example 3 | A300 | 100.0 | DC-902P | 4.0 | — | — | — | — |
| Comparative Example 4 | A300 | 100.0 | — | — | — | — | PAS-A5 | 4.0 |
| Comparative Example 5 | A300 | 100.0 | DC-902P | 4.0 | — | — | — | — |
| Comparative Example 6 | A300 | 100.0 | DC-902P | 4.0 | — | — | — | — |
| Comparative Example 7 | A300 | 100.0 | DC-902P | 4.0 | — | — | — | — |
| Comparative Example 8 | A300 | 100.0 | DC-902P | 4.0 | — | — | — | — |
| Comparative Example 9 | A300 | 100.0 | — | — | FPV1000L | 4.0 | PAS-A5 | 1.0 |

| | Composition of ink-receiving layer | | | | | |
|---|---|---|---|---|---|---|
| | Cationic polymer not having sulfonyl groups | | Water-soluble polyvalent metal salt | | Sulfur-containing compound | |
| Example No. | Type | Content (parts by mass) | Type | Content (parts by mass) | Type | Content (parts by mass) |
| Example 1 | — | — | ZA-30 | 2.0 | — | — |
| Example 2 | — | — | ZA-30 | 2.0 | — | — |
| Example 3 | — | — | ZA-30 | 2.0 | — | — |

TABLE 1-continued

| Composition of ink-receiving layer of recording medium | | | | | | |
|---|---|---|---|---|---|---|
| Example 4 | — | — | ZA-30 | 2.0 | — | — |
| Example 5 | — | — | ZA-30 | 2.0 | — | — |
| Example 6 | — | — | ZA-30 | 0.5 | — | — |
| Example 7 | — | — | ZA-30 | 1.0 | — | — |
| Example 8 | — | — | ZA-30 | 4.0 | — | — |
| Example 9 | — | — | ZA-30 | 6.0 | — | — |
| Example 10 | — | — | HAP25 | 2.0 | — | — |
| Example 11 | — | — | ZA-30/HAP25 | 1.0/1.0 | — | — |
| Example 12 | — | — | ZA-30 | 2.0 | — | — |
| Example 13 | — | — | ZA-30 | 2.0 | — | — |
| Example 14 | — | — | ZA-30 | 2.0 | — | — |
| Example 15 | — | — | ZA-30 | 2.0 | 3,6-dithiaoctanediol | 2.0 |
| Example 16 | — | — | ZA-30 | 2.0 | Sulfur-containing polymer compound | 2.0 |
| Example 17 | — | — | ZA-30 | 2.0 | — | — |
| Comparative Example 1 | — | — | — | — | — | — |
| Comparative Example 2 | — | — | — | — | — | — |
| Comparative Example 3 | — | — | ZA-30 | 2.0 | — | — |
| Comparative Example 4 | — | — | ZA-30 | 2.0 | — | — |
| Comparative Example 5 | — | — | ZA-30 | 2.0 | 3,6-dithiaoctanediol | 2.0 |
| Comparative Example 6 | PAS-M-1L | 1.0 | ZA-30 | 2.0 | — | — |
| Comparative Example 7 | PAA-HCL-05 | 1.0 | ZA-30 | 2.0 | — | — |
| Comparative Example 8 | PAS-J-81 | 1.0 | ZA-30 | 2.0 | — | — |
| Comparative Example 9 | — | — | ZA-30 | 2.0 | — | — |

Evaluation

In the present invention, A to C in the evaluation criteria of each evaluation item are acceptable levels, and D and E are unacceptable levels. Incidentally, each evaluation was performed using an ink-jet recording apparatus, PIXUS MP990 (manufactured by CANON KABUSHIKI KAISHA) equipped with an ink cartridge BCI-321 (manufactured by CANON KABUSHIKI KAISHA). The recording conditions were a temperature of 23° C. and a relative humidity of 50%. In the ink-jet recording apparatus, an image recorded under conditions of a resolution of 600×600 dpi and application of one ink drop of about 11 ng to a unit region of 1/600×1/600 inch is defined as a recording duty of 100%.

Ozone Resistance of Image

A black patch (2.5×2.5 cm) was recorded on each recording medium produced above at an optical density of 1.0±0.1 using the ink-jet recording apparatus set to the mode of "luster pro platinum grade". The resulting image was placed in an ozone exposure tester OMS-H (manufactured by Suga Test Instruments Co., Ltd.) and was exposed to 5 ppm of ozone at a temperature of 23° C. and a relative humidity of 50% for 72 hours. The optical densities of the black patch before and after the exposure test were measured with a spectrophotometer Spectrolino (manufactured by Gretag Macbeth A.G.), and the density residual ratio of each of the cyan, magenta, and yellow components was calculated by the following Expression:

$$\text{Density residual ratio}(\%)=(\text{image density after test}/\text{image density before test})\times 100$$

The ozone resistance of each image was evaluated on the basis of the density residual ratio of the cyan component, which was judged, from the density residual ratios, to be mostly affected by ozone. Incidentally, a larger density residual ratio means higher ozone resistance of an image. The evaluation criteria are as follows:

A: the density residual ratio of cyan component was 82% or more,

B: the density residual ratio of cyan component was 79% or more and less than 82%, C: the density residual ratio of cyan component was 76% or more and less than 79%, D: the density residual ratio of cyan component was 73% or more and less than 76%, and E: the density residual ratio of cyan component was less than 73%.

The evaluation results are shown in Table 2.

Color Development of Image

A black solid image (an image of a recording duty of 100%) of 2.5×2.5 cm was recorded on each recording medium produced above using the ink-jet recording apparatus set to the mode of "luster pro platinum grade, no color correction". The optical density of the resulting image was measured with a reflection densitometer 530 spectral densitometer (manufactured by X-Rite Inc.). The color development of each image was evaluated from the resulting optical density. Incidentally, a larger optical density means the higher color development of an image. The evaluation criteria are as follows:

A: the optical density was 2.35 or more,

B: the optical density was 2.25 or more and less than 2.35,

C: the optical density was 2.15 or more and less than 2.25,

D: the optical density was 2.05 or more and less than 2.15, and

E: the optical density was less than 2.05.

The evaluation results are shown in Table 2.

Light Resistance of Image

A black patch (2.5×2.5 cm) was recorded on each recording medium produced above at an optical density of 1.0±0.1 using the ink-jet recording apparatus set to the mode of "luster pro platinum grade". The resulting image was placed in a xenon light tester, low-temperature cycle xenon weather meter XL-75 (manufactured by Suga Test Instruments Co., Ltd.) and was exposed to xenon light at a tank internal temperature of 23° C., a tank internal humidity of 50%, a black panel temperature of 23° C., and an integrated illuminance of 35000 klx-hour. The optical densities of the black patch before and after the exposure test were measured with a spectrophotometer Spectrolino (manufactured by Gretag Macbeth A.G.), and the density residual ratio of each component of cyan, magenta, and yellow was calculated by the following Expression:

$$\text{Density residual ratio}(\%)=(\text{image density after test}/\text{image density before test})\times 100$$

The light resistance of each image was evaluated on the basis of the density residual ratio of the yellow component, which was judged, from the density residual ratios, to be mostly affected by light. Incidentally, a larger density residual ratio means the higher light resistance of an image. The evaluation criteria are as follows:

A: the density residual ratio of yellow component was 85% or more,

B: the density residual ratio of yellow component was 82% or more and less than 85%, C: the density residual ratio of yellow component was 79% or more and less than 82%, D: the density residual ratio of yellow component was 76% or more and less than 79%, and E: the density residual ratio of cyan component was less than 76%.

The evaluation results are shown in Table 2.

Humidity Resistance of Image

A solid image of a 20-point outline character, "A", was recorded with secondary color (blue) of cyan and yellow (ink was applied to only the outline of the character) on each recording medium produced above using the ink-jet recording apparatus set to the mode of "luster pro platinum grade, no color correction". On this occasion, the recording duty of the cyan ink was 150%, and the recording duty of the magenta ink was 150%. The resulting image was stored under high humidity conditions, a temperature of 30° C. and a relative humidity of 90%, for one week, and the white portion of the image was visually investigated to evaluate the humidity resistance of the image. The evaluation criteria are as follows:

A: no leaching of color to the white portion of the character was observed,

B: slight leaching of color to the white portion of the character was observed, but it was not noticeable, C: leaching of color to the white portion of the character was observed, but the line width of the white portion was not less than the half of that before the storage test, D: leaching of color to the white portion of the character was observed, and the line width of the white portion was less than the half of that before the storage test, and E: significant leaching of color to the white portion of the character was observed, and the character was not recognized.

The evaluation results are shown in Table 2.

Effect of Inhibiting Heat-Induced Yellowing of Recording Medium

Each recording medium produced above was stored under high temperature conditions, a temperature of 90° C. and a relative humidity of 50%, for 72 hours. The blank portion of the recording medium was measured for the L* values, a* values, and b* values before and after the storage test with a spectrophotometer Spectrolino (manufactured by Gretag Macbeth A.G.), and ΔE was calculated by the following Expression:

$$\Delta E=[\{(L^*\text{value of recorded matter before test})-(L^*\text{value of recorded matter after test})\}^2+\{(a^*\text{value of recorded matter before test})-(a^*\text{value of recorded matter after test})\}^2+\{(b^*\text{value of recorded matter before test})-(b^*\text{value of recorded matter after test})\}^2]^{1/2}$$

The effect of inhibiting the heat-induced yellowing of the recording medium was evaluated from the resulting ΔE. Incidentally, a smaller ΔE means that the heat-induced yellowing of the recording medium is more inhibited. The evaluation criteria are as follows:

A: ΔE was less than 2.8,

B: ΔE was 2.8 or more and less than 3.3,

C: ΔE was 3.3 or more and less than 3.6,

D: ΔE was 3.6 or more and less than 3.9, and

E: ΔE was 3.9 or more.

The evaluation results are shown in Table 2.

TABLE 2

| Evaluation results | | | | | |
|---|---|---|---|---|---|
| | Evaluation results | | | | |
| Example No. | Ozone resistance of image | Color development of image | Light resistance of image | Humidity resistance of image | Effect of inhibiting heat-induced yellowing of recording medium |
| Example 1 | A | A | C | A | A |
| Example 2 | C | A | C | B | A |
| Example 3 | B | A | C | A | A |
| Example 4 | A | B | C | A | A |
| Example 5 | A | C | C | A | A |
| Example 6 | C | A | C | B | A |
| Example 7 | B | A | C | A | A |
| Example 8 | A | B | C | A | A |
| Example 9 | A | C | B | A | A |
| Example 10 | A | A | C | A | A |
| Example 11 | A | A | C | A | A |
| Example 12 | A | A | C | A | A |
| Example 13 | A | A | B | A | A |
| Example 14 | A | A | C | A | C |
| Example 15 | A | A | A | C | A |
| Example 16 | A | A | A | A | A |
| Example 17 | C | B | C | B | C |

TABLE 2-continued

| Evaluation results | | | | | |
|---|---|---|---|---|---|
| | Evaluation results | | | | |
| Example No. | Ozone resistance of image | Color development of image | Light resistance of image | Humidity resistance of image | Effect of inhibiting heat-induced yellowing of recording medium |
| Comparative Example 1 | E | A | D | D | A |
| Comparative Example 2 | D | B | C | C | A |
| Comparative Example 3 | D | B | C | C | A |
| Comparative Example 4 | D | E | C | C | A |
| Comparative Example 5 | D | A | C | C | A |
| Comparative Example 6 | D | A | C | A | A |
| Comparative Example 7 | D | A | C | A | D |
| Comparative Example 8 | D | A | C | A | C |
| Comparative Example 9 | C | D | C | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-086535 filed Apr. 5, 2012, which is hereby incorporated by reference herein in its entirety.

What is claimed is:

1. A recording medium comprising:

a base; and an ink-receiving layer, wherein the ink-receiving layer comprises inorganic particles, a binder, a poly(diallyldimethylamine hydrochloride), a cationic polymer having a sulfonyl group, and a polyvalent metal, wherein the content of the poly(diallyldimethylamine hydrochloride) in the ink-receiving layer is 1 part by mass or more and 10 parts by mass or less based on 100 parts by mass of the inorganic particles, wherein the content of the cationic polymer having a sulfonyl group in the ink-receiving layer is 0.1 parts by mass or more and 5 parts by mass or less based on 100 parts by mass of the inorganic particles, and wherein the content of the polyvalent metal in the ink-receiving layer is 0.1 parts by mass or more and 10 parts by mass or less based on 100 parts by mass of the inorganic particles.

2. The recording medium according to claim 1, wherein the inorganic particles are gas-phase method silica.

3. The recording medium according to claim 1, wherein the cationic polymer having a sulfonyl group comprises a compound represented by the following Formula (1):

[Chem. 1]

Formula (1)

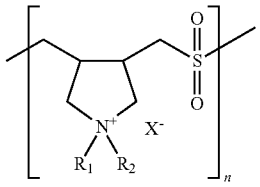

(in Formula (1), $R_1$ and $R_2$ each represent a hydrogen atom or an alkyl group, provided that $R_1$ and $R_2$ are not simultaneously hydrogen atoms; $X^-$ represents a halogen ion, a sulfate ion, a sulfonate ion, an alkylsulfonate ion, an acetate ion, an alkylcarboxylate ion, or a phosphate ion; and n is an integer).

4. The recording medium according to claim 1, wherein the polyvalent metal comprises at least one selected from zirconium and aluminum.

5. The recording medium according to claim 1, wherein the content of the poly(diallyldimethylamine hydrochloride) in the ink-receiving layer is 1 part by mass or more and 10 parts by mass or less based on 100 parts by mass of the inorganic particles.

6. The recording medium according to claim 1, wherein the content of the cationic polymer having a sulfonyl group in the ink-receiving layer is 0.1 parts by mass or more and 5 parts by mass or less based on 100 parts by mass of the inorganic particles.

7. The recording medium according to claim 1, wherein the content of the polyvalent metal in the ink-receiving layer is 0.1 parts by mass or more and 10 parts by mass or less based on 100 parts by mass of the inorganic particles.

* * * * *